US010943715B2

(12) United States Patent
Roberts et al.

(10) Patent No.: US 10,943,715 B2
(45) Date of Patent: Mar. 9, 2021

(54) FORCE SENSITIVE RESISTOR

(71) Applicant: NURVV LIMITED, Twickenham (GB)

(72) Inventors: Jason Roberts, Twickenham (GB); Grant Trewartha, Derry Hill (GB); Haim Geva, London (GB); Giles Tongue, West Byfleet (GB); Kemal Dervish, Welwyn Garden City (GB)

(73) Assignee: NURVV LIMITED, Twickenham (GB)

( * ) Notice: Subject to any disclaimer, the term of this patent is extended or adjusted under 35 U.S.C. 154(b) by 0 days.

(21) Appl. No.: 16/520,908

(22) Filed: Jul. 24, 2019

(65) Prior Publication Data

US 2020/0035388 A1 Jan. 30, 2020

(30) Foreign Application Priority Data

Jul. 27, 2018 (GB) ..... 1812297

(51) Int. Cl.
*H01C 10/10* (2006.01)
*H01C 7/00* (2006.01)
*H01C 17/065* (2006.01)

(52) U.S. Cl.
CPC ..... *H01C 10/106* (2013.01); *H01C 7/005* (2013.01); *H01C 17/0652* (2013.01)

(58) Field of Classification Search
CPC ..... H01C 10/106; H01C 10/12; H01C 7/005; H01C 17/0652
See application file for complete search history.

(56) References Cited

U.S. PATENT DOCUMENTS 8,020,456 B2 * 9/2011 Liu ..... B82Y 10/00 73/862.621
9,631,989 B1 4/2017 Asiri et al.
2008/0116424 A1 * 5/2008 Bandyopadhyay .... H01C 7/027 252/513
2009/0309172 A1 * 12/2009 Liu ..... B82Y 10/00 257/415
2012/0073388 A1 * 3/2012 Chibante ..... G01L 1/20 73/862.627
2012/0090408 A1 4/2012 Jheng et al.
(Continued)

FOREIGN PATENT DOCUMENTS

JP 2017009559 A 1/2017

OTHER PUBLICATIONS

Intellectual Property Office (UK), Search Report issued in corresponding Application No. GB182297.8, dated Jan. 21, 2019.

*Primary Examiner* — Kyung S Lee
(74) *Attorney, Agent, or Firm* — Stites & Harbison, PLLC; Jeffrey A. Haeberlin; Gary N. Stewart

(57) ABSTRACT

A force sensitive resistor includes first and second electrical contacts, and a layer of deformable material impregnated with carbon nanotubes. The layer of deformable material is arranged between the first and second electrical contacts. A difference in the conductivity of the impregnated material caused by deformation of the material is detectable across the contacts. A method of manufacturing a force sensitive resistor includes the steps of providing first and second electrical contacts, and arranging a deformable material impregnated with carbon nanotubes between the first and second electrical contacts. Again, a difference in the conductivity of the impregnated material caused by deformation of the material is detectable across the contacts.

10 Claims, 5 Drawing Sheets

(56) References Cited

U.S. PATENT DOCUMENTS

| | | | | |
|---|---|---|---|---|
| 2012/0235781 | A1 | 9/2012 | Abu Samah | |
| 2012/0266685 | A1* | 10/2012 | Choi | G01L 1/20 73/774 |
| 2013/0218050 | A1 | 8/2013 | Eichhorn et al. | |
| 2015/0177079 | A1 | 6/2015 | Eichhorn et al. | |
| 2017/0350772 | A1 | 12/2017 | Deganello et al. | |
| 2018/0017450 | A1 | 1/2018 | Jiang et al. | |

* cited by examiner

FORCE SENSITIVE RESISTOR

CROSS-REFERENCE TO RELATED APPLICATIONS

This application claims the benefit of United Kingdom Patent Application No. GB1812297.8, filed Jul. 27, 2018, the entire disclosure of which is incorporated herein by this reference.

STATEMENT REGARDING FEDERALLY SPONSORED RESEARCH OR DEVELOPMENT

Not applicable.

THE NAMES TO PARTIES TO A JOINT RESEARCH AGREEMENT

Not applicable.

INCORPORATION-BY-REFERENCE OF MATERIAL SUBMITTED ON A COMPACT DISC

Not applicable.

BACKGROUND OF THE INVENTION

Field of the Invention

The present invention relates to an improved force sensitive resistor.

Description of the Related Art

Force sensitive resistors are well known and generally work by having a two or more spaced apart contacts. As a force is applied to the force sensitive resistor, the contacts are moved towards one another and hence the resistance across these contacts reduces.

BRIEF SUMMARY OF THE INVENTION

These force sensitive resistors depend upon ventilation to operate as air or other operating gas must be expelled from between the first and second contacts. As a result, the force sensitive resistor can collapse when there is insufficient air ventilation which leads to reliability issues. Furthermore, these sensors are essentially incremental "on/off" binary switches and cannot provide a true continuous quantitative force measurement. Finally, these force sensitive resistors cannot act as structural elements and as such the rest of the design must be adjusted accordingly.

There is therefore a need for an improved force sensitive resistor.

According to one aspect of the present invention there is provided a force sensitive resistor including first and second electrical contacts and a layer of deformable material impregnated with carbon nanotubes. The layer is arranged between the first and second electrical contacts wherein a difference in the conductivity of the impregnated material caused by deformation of the material is detectable across the contacts. The force sensitive resistor is highly reliable and accurate. This force sensitive resistor is particularly suitable for use on deformable items such as clothing as it can readily flex therewith. The spacer material spaces the first and second material and deforms with the deformable item. This avoids issues with respect to the sensor collapsing. The force sensitive resistor can also provide a continuous quantitative reading rather than a binary "on/off". The use of the deformable material also allows a force sensitive resistor with no air vent to be produced.

The deformable material may be impregnated with carbon nanotubes at less than 10% of carbon nanotubes by weight, preferably less than 5%, more preferably less than 3%. The percentages by weight are much lower than for conventional materials used in conductive polymers, such as carbon black. As such, a smaller amount of material needs to be used for the same level of conductivity. As a smaller amount of material is used the physical and mechanical properties of the matrix material are better retained.

The carbon nanotubes may have an average outer diameter of less than 150 nm, preferably less than 50 nm, and more preferably less than 15 nm. It has been found that carbon nanotubes having an average diameter in this region provide good electrical conductivity characteristics.

The carbon nanotubes may have an average aspect ratio of more than 50, preferably more than 150, and more preferably more than 1000. It has been found that carbon nanotubes having an aspect ratio in this region provide good electrical conductivity characteristics.

The carbon nanotubes may be single-walled. It has been found that single walled carbon nanotubes can produce in the region of 10% better electrical conductivity. The choice of which type of nanotube to use could depend upon the end application and required costs and accuracy.

The first and second electrical contacts and the layer of deformable material may be sealed in a substantially airtight housing. As the deformable material does not need any air path for displaced air the sensor can be made entirely watertight and/or airtight. This aids its use in applications where ingress or air or water is undesirable.

The deformable material may be a polymer. Polymers are particularly suitable for use as deformable materials due to their ability to accommodate variable concentrations of carbon nanotubes in readily available manufacturing processes.

The deformable material may be elastomeric, preferably a compliant elastomeric. The ease of deformation of such materials ensures an accurate reading even when low amplitude forces are applied. Resilient compliant elastomerics will return to their original shape relatively quickly and will aid the force sensitive resistor in detecting low amplitude high frequency applications of force.

The deformable material may be an engineering plastic. These materials will return to their original shapes relatively quickly and this aids the force sensitive resistor in detecting high frequency applications of force.

The deformable material may be a thermoplastic elastomer, for example thermoplastic polyurethanes, thermoplastic co-polyesters, or thermoplastic vulcanizate.

According to another aspect of the invention, a method of manufacturing a force sensitive resistor includes the steps of providing first and second electrical contacts, and arranging a deformable material impregnated with carbon nanotubes between the first and second electrical contacts. A difference in the conductivity of the impregnated material caused by deformation of the material is detectable across the contacts. This method results in a force sensitive resistor with the benefits discussed above.

BRIEF DESCRIPTION OF THE DRAWINGS

The present invention will now be described with reference to the accompanying drawings in which.

DETAILED DESCRIPTION OF EXEMPLARY EMBODIMENTS OF THE INVENTION

Figure 1A:
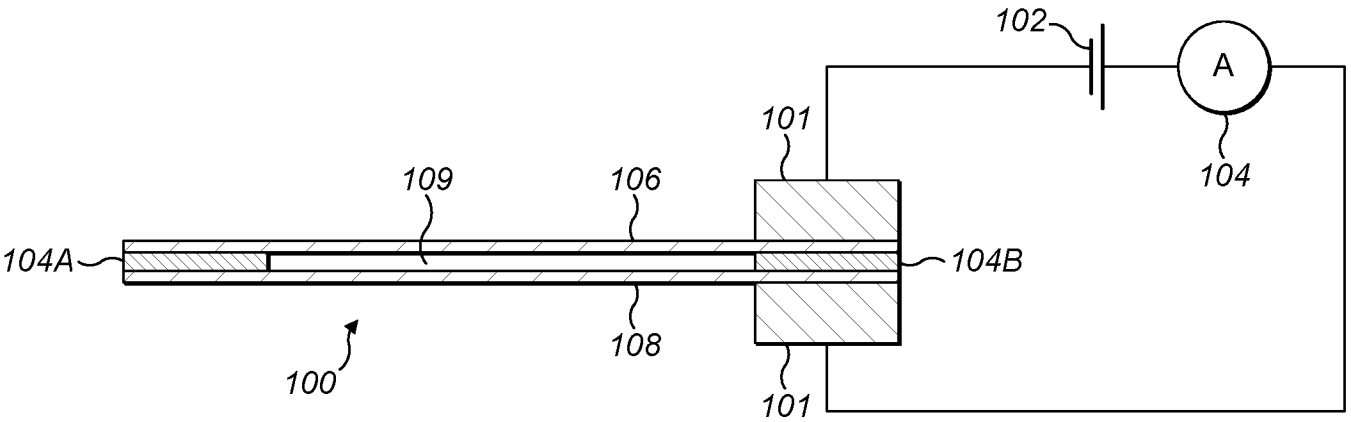
FIG. 1A (Prior Art)
FIG. 1A shows a prior art force sensitive resistor.
Figure 1B:
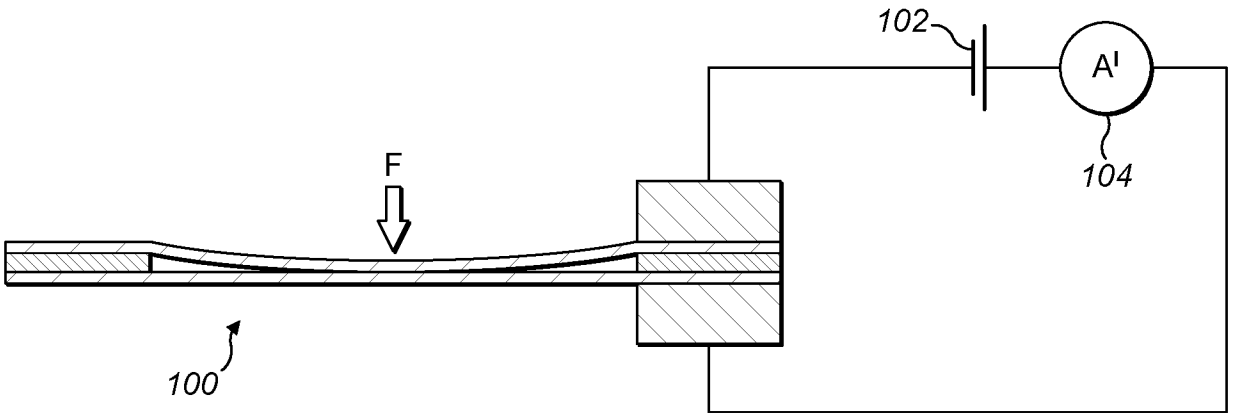
FIG. 1B (Prior Art)
FIG. 1B shows the prior art force sensitive resistor in a compressed state.

FIG. 1A and FIG. 1B show a prior art force sensitive resistor 100. The force sensitive resistor 100 comprises first and second electrical conductors 106, 108. The first and second electrical conductors 106, 108 are spaced apart from one another in the relaxed state (FIG. 1A) by spacers 104A, 104B. An air (or other media) gap 109 is provided therebetween. Electrical contacts 101 connect each of the first and second electrical conductors 106, 108 to an electrical circuit including a power source 102 and an ammeter 104. In this relaxed state (FIG. 1A) the ammeter 104 has a first reading A.

A force F is then applied to the first and second electrical conductors 106, 108 which forces them towards each other. The top conductor 106 bends towards the lower conductor 108. Air (or other media) is expelled from the gap 109 and an electrical contact is formed between the first and second electrical conductors 106, 108. The electrical circuit is therefore completed and the force sensitive resistor 100 switches on. This allows current to flow through the circuit and the ammeter 104 has a second reading A'.

Figure 2A:
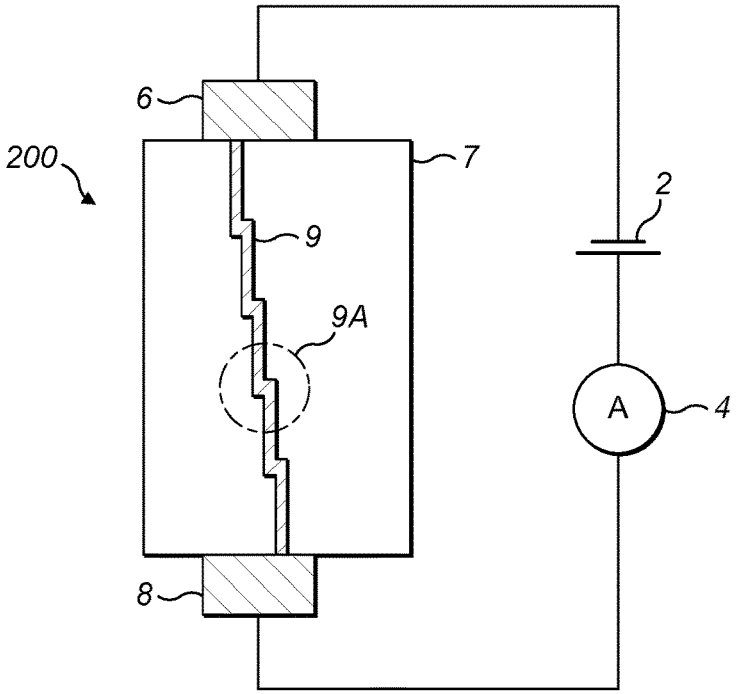
FIG. 2A shows a schematic force sensitive resistor according to the present invention.
Figure 2B:
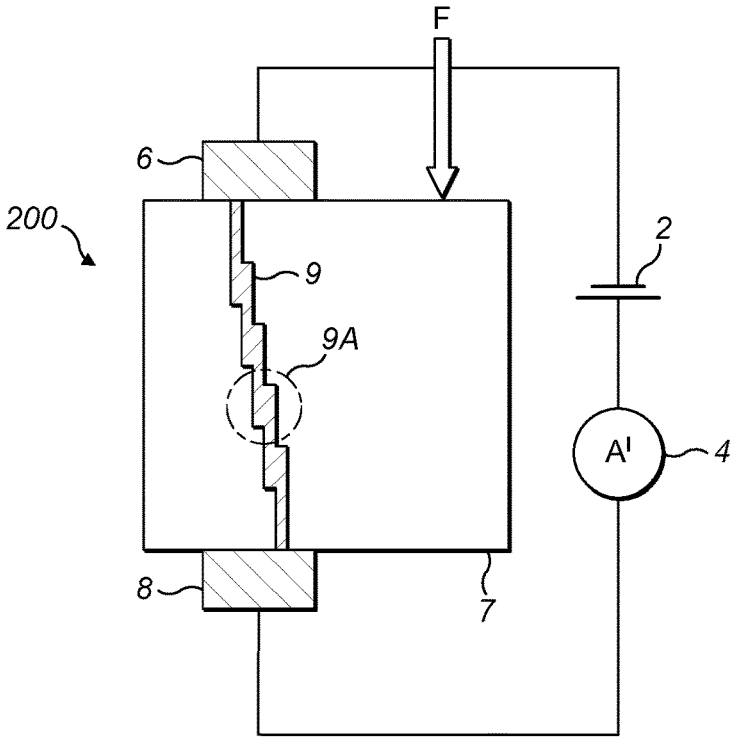
FIG. 2B shows the force sensitive resistor of FIG. 2A in a compressed state.

FIG. 2A and FIG. 2B show a schematic of a force sensitive resistor 200 according to the present invention. First and second electrical contacts 6, 8 are provided. A deformable material 7 is provided sandwiched between these first and second electrical contacts 6, 8. The deformable material 7 is impregnated with carbon nanotubes 9. Purely for exemplary purposes these carbon nanotubes 9 are shown generally axially aligned in FIG. 2A and FIG. 2B. However, it is appreciated that the carbon nanotubes 9 in practice are likely to be randomly distributed throughout the deformable material 7 and may or may 5 not contact one another.

The carbon nanotubes 9 have an effective conductive cross-sectional area 9A. In the relaxed position (FIG. 2A) this area 9A is relatively low and hence there is a relatively lower conductivity across the force sensitive resistor 200. The force sensitive resistor 200 is provided in an electrical circuit with a power source 2 and an ammeter 4. The ammeter 4 has a first reading A.

A force F is then applied to the force sensitive resistor 200. The deformable material 7 is compressed, but generally retains its overall volume. As a result, the carbon nanotubes 9 are forced towards one another and the effective conductive cross-sectional area 9A increases. While the aligned carbon nanotubes 9 of the schematic clearly increase this area 9A by having a greater contact, it is also anticipated that this effective conductive cross-sectional area 9A may also relate to the reduction in capacitance as carbon nanotubes 9 which do not touch are moved towards one another.

As this area 9A increases, so does the conductivity of the force sensitive resistor 200 as the overall resistance decreases. Accordingly, more current is able to flow through the force sensitive resistor 200 and hence the circuit and the ammeter 4 has a second reading A'. In contrast to the prior art, there is no air to be expelled as the force sensitive resistor 200 compresses.

The impregnated deformable material 7 may be manufactured according to any suitable known technique. 3D printing, in particular fused filament fabrication (FFF) or fused deposition modelling (FDM), may be particularly beneficial as it allows the orientation of the carbon nanotubes 9 to be controlled to a greater degree than other methods. This enhances the force sensitive resistor 200. The first and second electrical contacts 6, 8 and any housing for the force sensitive resistor 200 can also be printed at the same time in different layers if a multi-filament printer is used. Further circuitry to connect the force sensitive resistor 200 to other electrical components could also be 3D printed at the same time.

First Embodiment

Figure 3A:
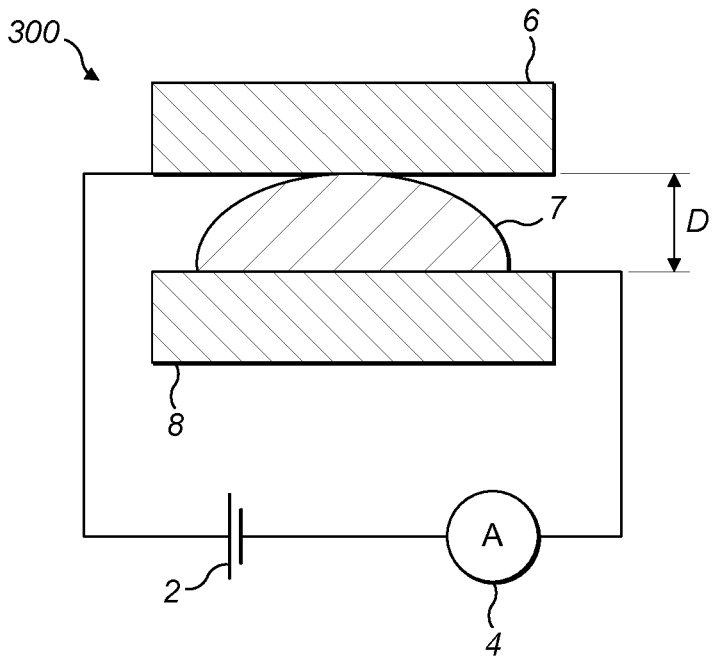
FIG. 3A shows a compressive force sensitive resistor according to a first embodiment of the present invention.

FIG. 3A shows a force sensitive resistor 300 according to a first embodiment of the present invention. The force sensitive resistor 300 is provided with first and second electrical contacts 6, 8 which are spaced apart from one another a distance D. In between the first and second electrical contacts 6, 8, a layer of deformable material 7 is provided. The first and second electrical contacts 6, 8 may substantially sandwich this layer of deformable material 7.

The first and second electrical contacts 6, 8 are provided in an electrical circuit which includes a power source 2 and an ammeter 4. Of course, the ammeter 4 may be replaced with a controller which is able to determine the current flowing through the circuit, or any other characteristic that would allow the controller to determine the resistance of the layer of deformable material 7. The power source 2 may be a battery or mains supply or any other well-known power source.

The layer of deformable material 7 is impregnated with carbon nanotubes. Carbon nanotubes (CNTs) are generally well known allotropes of carbon with a cylindrical nanostructure. Generally, carbon nanotubes have a high conductivity and high aspect ratio (length to diameter ratio) which help them to form a network of conductive tubes. Conductive nanotubes may be categorized in at least three forms, single-wall carbon nanotubes, double-wall or multi-wall. The name relates to the number of coaxial layers of nanotube provided. Generally, multi-wall carbon nanotubes are easier to produce and have a lower product cost per unit along with enhanced thermal and chemical stability. Carbon nanotubes may be provided in powder form.

Due to the high conductivity of carbon nanotubes along their main axis these may be incorporated into materials to ensure a high electrical conductivity of the material. In particular, carbon nanotubes may be provided in an amount of approximately 1 to 10% by weight while still ensuring good conductivity.

In other examples, the deformable material could be impregnated with conductive metal particles, such as silver particles. In these examples, the silver conductive particles must be provided in an amount of approximately 35 to 40% by weight. At these ratios it can be difficult to ensure that the matrix material retains its mechanical and physical properties and that the particles are evenly spread throughout the material and hence that the resistor is providing accurate readings across its entire range.

As a result, when the layer of deformable material 7 is deformed and changes in shape, its resistance and hence conductivity is altered. As a result of its resistance being altered the current flowing through the circuit is varied as the current is equal to the voltage supplied by the power source 2 divided by the resistance of the layer of deformable material 7.

Figure 3B:
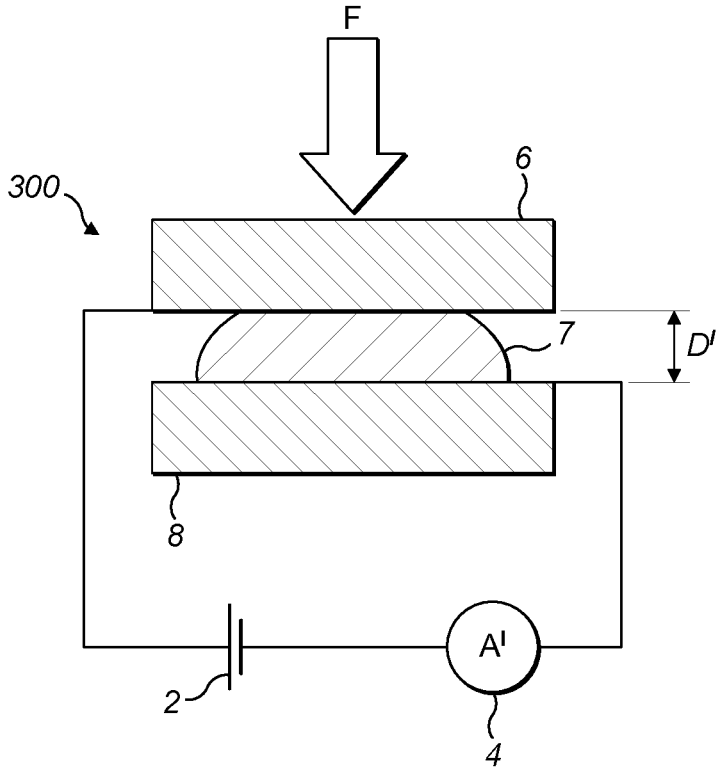
FIG. 3B shows the force sensitive resistor of FIG. 3A in a compressed state.

FIG. 3B shows the force sensitive resistor 300 following a compressive force F having been applied. The compressive force F forces the first and second electrical contacts 6, 8 towards one another and hence the distance D is changed to a second distance D'. In moving the first and second electrical contacts 6, 8 together the layer of deformable material 7 has been deformed from its initial position. As a result of this deformation the resistance of the layer of deformable material 7 is reduced and hence the current A' flowing through the circuit is increased.

A processor or further system (not shown) can then detect the change in current and hence determine the force F applied to the force sensitive resistor 300.

As discussed above, the amount of carbon nanotubes provided in the layer of deformable material 7 may be in the region of 1% to 10% by weight. In preferable embodiments this may be less than 5%. In more preferable embodiments this may be less than 3%. In a particular embodiment the amount of carbon nanotubes by weight may be 2%.

The carbon nanotubes in the layer of deformable material 7 may have an average diameter of less than 100 nm, preferably less than 50 nm, and more preferably less than 20 nm.

While the multi-walled carbon nanotubes are more available as discussed above it has been found that single-walled carbon nanotubes are more suitable for this application as they produce higher conductivity at lower concentrations. However, multi-walled carbon nanotubes may still be used.

While no outer housing is depicted in FIG. 3A or 3B, it is anticipated that the present invention may be used in a force sensitive resistor including an outer housing surrounding the first and second electrical contacts 6, 8 and the layer of deformable material 7 such that they are sealed in an airtight and/or watertight volume. The layer of deformable material 7 may be constructed devoid of air gaps. As such, there is no need to provide a route for the outlet of displaced air.

The deformable material is preferably a polymer. If the force sensitive resistor 300 experiences a sequence of force applications it must recover its original shape as best as possible between repeated applications. This enables the force sensitive resistor 300 to return to the unperturbed state (i.e. with zero force applied) before being subjected to the following force application. The ability to return to the unperturbed state between force loading occurrences therefore affects the ability of the force sensitive resistor 300 to measure repeated loading. This ability to recover between repeating force applications is related directly to the composition of the deformable material.

Soft elastomeric materials may enable accurate measurements because they deform to a larger extent. This is particularly useful for detecting small forces. Large forces may result in a maximum amount of deformation being exceeded which the force sensitive resistor 300 cannot detect. However, some of these soft elastomeric materials recover slowly and as such may not recover in time for a high-frequency repeated load.

In particular embodiments, the deformable material may be silicone rubber or natural rubber. Silicone rubber is soft but resilient with low recovery time. It is therefore suitable for low-amplitude high-frequency detection. Natural rubber is generally harder and still has a low recovery time. As such natural rubber is more suited for medium-force high frequency detection.

As an alternative, engineering plastics are harder and stiffer than elastomers. Engineering plastics are a group of plastic materials that have better mechanical and/or thermal properties than the more widely used commodity plastics. Engineering plastics may include at least acrylonitrile butadiene styrene (ABS); nylon 6; nylon 6-6; polyamides (PA); polybutylene terephthalate (PBT); polycarbonates (PC); polyetheretherketone (PEEK); polyetherketone (PEK); polyethylene terephthalate (PET); polyimides; polyoxymethylene plastic (POM/acetal); polyphenylene sulfide (PPS); polyphenylene oxide (PPO); polysulphone (PSU); polytetrafluoroethylene (PTFE/teflon); and thermoplastic polyurethane (TPU).

Engineering plastics do not deform very much when low forces are applied to them. Therefore a force sensitive resistor 300 using an engineering plastic as the deformable material will struggle to measure low forces. However, engineering plastics recover their initial shape much quicker than elastomers. Therefore, a force sensitive resistor 300 using an engineering plastic as the deformable material would be suitable for measurements of high-frequency repeating force applications.

Thermoplastic polyurethane (TPU) may be suitable for use in a force sensitive resistor 300 designed to detect high forces applied at a high frequency and high forces applied at a low frequency.

Thermoplastic elastomers (TPE) can generally be classified into stiff TPEs and soft TPEs. A stiff TPE may be used to detect similar force patterns to TPU. A soft TPE can be used as the deformable material in a force sensitive resistor 300 arranged to detect low amplitude, low frequency forces.

Second Embodiment

Figure 4A:
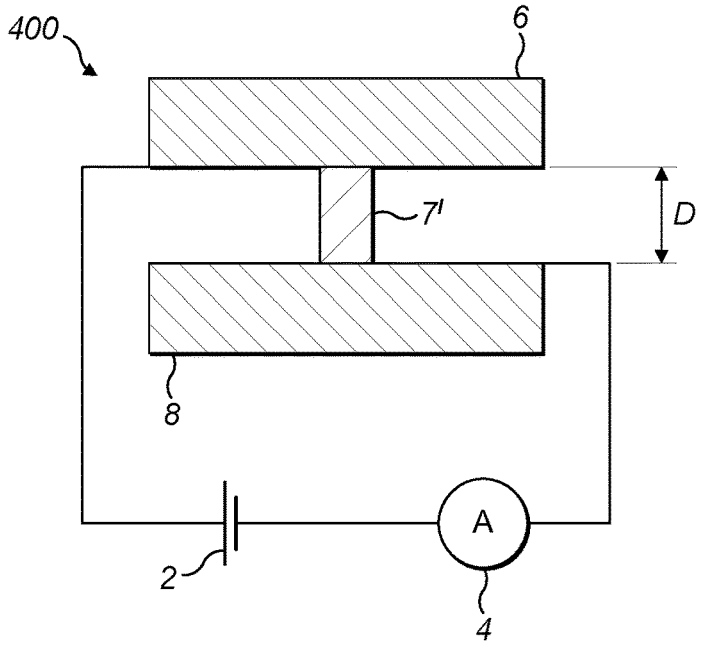
FIG. 4A shows a force sensitive resistor for detecting tensile force according to a second embodiment of the present invention.
Figure 4B:
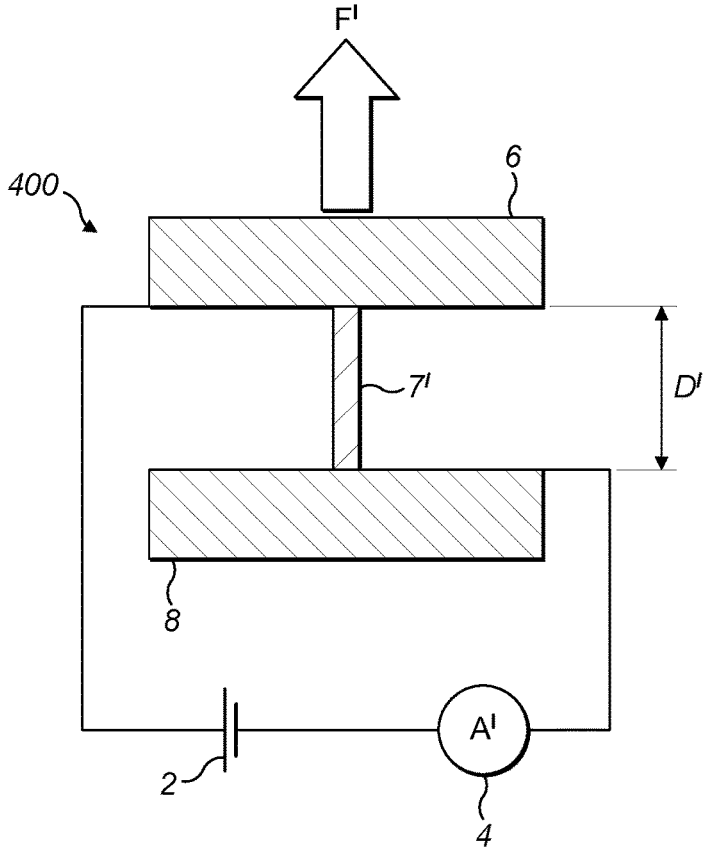
FIG. 4B shows the force sensitive resistor of FIG. 4A in an extended state.

A second embodiment of a force sensitive resistor 400 according to the present invention is shown in FIG. 4A and FIG. 4B. This force sensitive resistor 400 is configured to detect tensile forces being applied. That is, forces which act to separate the first and second electrical contacts 6, 8.

As can be seen in FIG. 4A and FIG. 4B the general arrangement of the circuit and first and second electrical contacts 6, 8 is the same as in FIG. 3A and FIG. 3B. The major difference is that the layer of deformable material 7' is provided as an elongate member attached to the first and second electrical contacts 6, 8. As the tensile force F' is applied the first and second electrical contacts 6, 8 are pulled away from one another 10 until they are separated by a distance D'. As a result, the layer of deformable material 7' is extended. Again, this extension of the layer of deformable material 7' will vary its conductive properties such as resistance and hence the ammeter 4 will detect a different current A' which can be detected and converted to determine the force F' applied to the force sensitive resistor 400.

Any modifications discussed with respect to the first embodiment of the force sensitive resistor 300 can likewise be applied to the second embodiment of the force sensitive resistor 400. In particular, relating to the air-tight and/or water tight possibilities. Likewise, the deformable material of the second embodiment of the force sensitive resistor 400 can be selected for a desired detection capabilities as discussed above with respect to the first embodiment of the force sensitive resistor 300.

Method of Manufacturing

A method of manufacturing each of the first and second embodiments of the force sensitive resistor 300, 400 is also provided according to the present invention. This method includes the steps of providing first and second electrical contacts 6, 8. A deformable material 7, 7' impregnated with carbon nanotubes is then arranged between the first and second electrical contacts 6, 8. This results in the force sensitive resistors 300, 400 of the first and second embodiments of the present invention.

The present invention also extends to a use of a layer of deformable material 7, 7' impregnated with carbon nanotubes between first and second electrical contacts 6, 8 to form a force sensitive resistor 300, 400.

Third Embodiment

Figure 5:
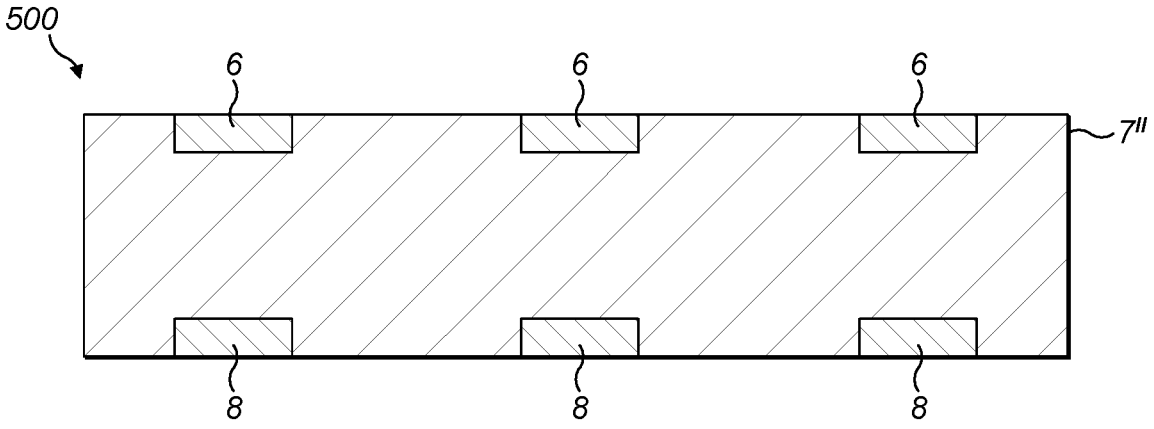
FIG. 5 shows a force sensitive resistor according to a third embodiment of the present invention.

FIG. 5 shows a third embodiment of a force sensitive resistor 500 according to the present invention. In this embodiment a plurality of first and second electrical contacts 6, 8 are provided spanning along a length of the force sensitive resistor 500. The first and second electrical contacts 6, 8 are provided in pairs. A single unitary deformable material 7" is provided. This layer of deformable material 7" bridges the gap between each of the first and second electrical contacts 6, 8. That is, the layer of deformable material 7" is common to each pair of first and second electrical contacts 6, 8. This allows a measurement of the distribution of force to be determined. It may be necessary to include a processor or other controller which can calibrate to remove the effect of cross-signals between adjacent sensors. That is, there may be contributory currents being transmitted from one first and/or second contact to multiple second and/or first contacts.

Fourth Embodiment

Figure 6:
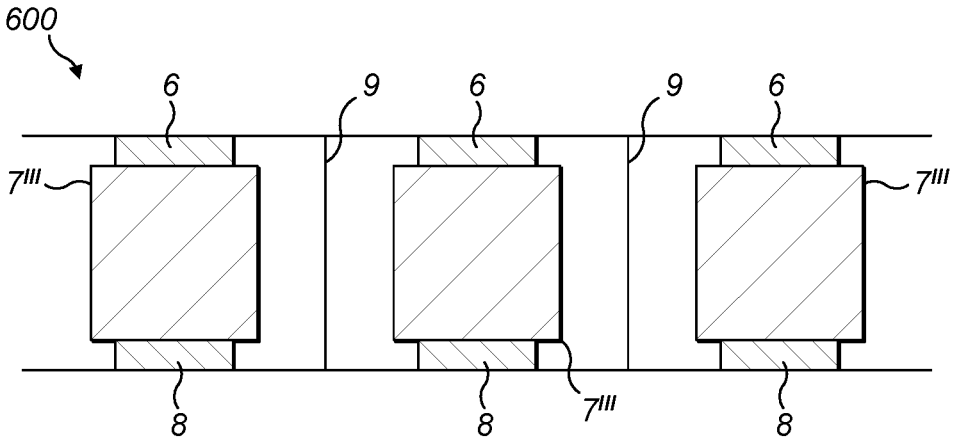
FIG. 6 shows a force sensitive resistor according to a fourth embodiment of the present invention.

A fourth embodiment force sensitive resistor 600 is shown in FIG. 6. As with the third embodiment there is a plurality of first and second electrical contacts 6, 8. In this embodiment there is also a plurality of layers of deformable material 7'". Each layer of deformable material 7'" is provided between one pair of first and second electrical contacts 6, 8. As such, as the force sensitive resistor 600 deforms each pair of electrical contacts 6, 8 will deform individually and produce their own localized signal. There are no cross-signals between adjacent pairs of contacts. In preferable embodiments there may be partition walls 10 provided between adjacent pairs of electrical contacts 6, 8. These walls may be spaced from the layer of deformable material 7'" or, alternatively, the layer of deformable material 7'" may substantially fill the volume between the walls 10.

Each of the embodiments shown in FIG. 5 and FIG. 6 may include any of the modifications discussed above with respect to the force sensitive resistors 300, 400 of FIGS. 3A to 4B.

What is claimed is:

1. A force sensitive resistor comprising:

first and second electrical contacts; and a layer of deformable material impregnated with carbon nanotubes, the layer of deformable material arranged between the first and second electrical contacts wherein a difference in conductivity of the deformable material caused by deformation is detectable across the contacts;

wherein the deformable material retains its overall volume when compressed;

wherein the carbon nanotubes have an average outer diameter of less than 150 nm, preferably less than 50 nm, more preferably less than 15 nm, and have an average aspect ratio of more than 50, preferably more than 150, more preferably more than 1000.

2. The force sensitive resistor according to claim 1, wherein the deformable material is impregnated with carbon nanotubes at less than 10% of carbon nanotubes by weight, preferably less than 5%, more preferably less than 3%.

3. The force sensitive resistor according to claim 1, wherein the carbon nanotubes are single-walled.

4. The force sensitive resistor according to claim 1, wherein the first and second electrical contacts and the layer of deformable material are sealed in a substantially airtight housing.

5. The force sensitive resistor according to claim 1, wherein the deformable material is a polymer.

6. The force sensitive resistor according to claim 1, wherein the deformable material is elastomeric, preferably silicone rubber or natural rubber.

7. The force sensitive resistor according to claim 1, wherein the deformable material is an engineering plastic.

8. The force sensitive resistor according to claim 1, wherein the deformable material is a thermoplastic elastomer, preferably thermoplastic polyurethanes, thermoplastic co-polyesters or thermoplastic vulcanizate.

9. A method of manufacturing a force sensitive resistor comprising the steps of:

providing first and second electrical contacts; and arranging a deformable material impregnated with carbon nanotubes between the first and second electrical contacts, wherein a difference in conductivity of the deformable material caused by deformation is detectable across the contacts and the deformable material retains its overall volume when compressed;

wherein the carbon nanotubes have an average outer diameter of less than 150 nm, preferably less than 50 nm, more preferably less than 15 nm, and have an average aspect ratio of more than 50, preferably more than 150, more preferably more than 1000.

10. The force sensitive resistor according to claim 1, wherein the deformable material is devoid of air gaps.

* * * * *